United States Patent [19]

Wilson

[11] Patent Number: 4,967,993

[45] Date of Patent: Nov. 6, 1990

[54] SUPPORT MEMBER

[75] Inventor: Neil Wilson, 28 Burra Street, New South Wales, 2145, Pendle Hill, Australia

[73] Assignee: Neil Wilson, Pendle Hill, Australia

[21] Appl. No.: 283,954

[22] Filed: Dec. 19, 1988

[30] Foreign Application Priority Data

Apr. 14, 1986 [AU] Australia ..... PH5443

[51] Int. Cl.[5] ..... A47F 7/14

[52] U.S. Cl. ..... 248/475.1; 206/806; 248/489; 248/544

[58] Field of Search ..... 248/475.1, 479, 484, 248/485, 486, 487, 489, 544, 547, 497; 40/606, 152.1; 206/575, 806

[56] References Cited

U.S. PATENT DOCUMENTS

| | | | |
|---|---|---|---|
| 1,815,767 | 7/1931 | Susmer | 248/475.1 |
| 3,384,987 | 5/1968 | Prechtl | 248/489 X |
| 3,922,807 | 12/1975 | Shore | 40/152.1 |
| 4,228,982 | 10/1980 | Sellera | 248/475.1 X |

*Primary Examiner*—Ramon O. Ramirez

*Attorney, Agent, or Firm*—Harness, Dickey & Pierce

[57] ABSTRACT

A support bracket for an artwork frame comprising a first arm which is permanently secured to the frame by screws and has an eyelet to receive a picture wire, and a second arm which may project from the first arm to receive a securing bolt or other fastener through a hole at the distant end thereof. The second arm is thus used to secure the artwork during transport and/or for securing the artwork to the wall. The second arm may be pivoted as to be located behind the frame when the artwork is mounted, or removable.

9 Claims, 2 Drawing Sheets

SUPPORT MEMBER

This invention relates to an improved support member. The invention is particularly applicable to a support member in the form of a bracket for use in displaying and/or transporting framed articles, more particularly framed artwork, such as paintings, mosaics, tapestries, photographs and prints.

To display a framed artwork, the framed artwork is usually secured to or suspended from a display wall or picture rail via the frame on or within which the artwork has been located. When the framed artwork is suspended from the wall or rail, this may be achieved by hanging, for example a picture wire, which is secured to the frame through suitably located anchoring means such as staples or screw eyelets, over or in contact with a holding device, such as a hook, on the wall or rail.

On the other hand, when it is desired to secure the framed artwork to the display wall, such as by bolting or screwing the frame against the wall, this can be achieved by passing a screw thread through the wall into the back of the frame.

When the framed artwork forms part of a travelling exhibition and is to be moved to another location, it is usually packed into or secured to a travelling frame or upon a support stretcher, which in turn is carried in a specially prepared travelling box or crate. The interior dimensions of the travelling box are usually closely coordinated with the perimeter of the travelling frame or stretcher, so that the travelling frame or stretcher while resting on the bottom of the box, is in frictional engagement with at least two opposed inner walls of the box to prevent movement of the travelling frame or stretcher and therefore of the framed artwork within the box. To achieve this frictional engagement, the travelling box is generally tailor-made for each framed artwork or, in the case of an oversized box, padding is placed around the perimeter of the travelling frame to provide the frictional securement. Prior to locating the framed artwork on the travelling frame or upon the support stretcher, it is necessary that the anchoring means be removed so that the framed artwork surrounded by the travelling frame may lie flat in the box or so that the framed artwork may lie flat upon the support stretcher which in turn will lie flat in the travelling box.

As will be appreciated, each time a framed artwork is then prepared for display, the anchoring means must be replaced in the frame such that the frame may receive further or over-enlarged screw or staple holes. Therefore after a time, the back of the frame may not provide a suitable surface to locate the anchoring means to enable the mounting of the framed artwork, with the result that the frame must be replaced. As can often be the case with framed artworks, the frame may itself be of intrinsic value, in the sense of the contribution it makes to the overall object d'art, or is of considerable monetary worth. Accordingly, it is desirable to keep to a minimum the number of anchoring screw or staple holes inflicted into the frame to maximize the useful life of the frame.

It is an object of the present invention to provide a support member which alleviates or at least minimizes the problems associated with the prior art method for dismantling and assembling a framed article for travel and subsequent display.

According to the present invention, there is provided a support bracket for the frame of artwork and comprising a first arm including means facilitating securement of the first arm to the frame and means for engaging a wall support element, and a second arm adapted in a first condition to project from the first arm substantially parallel to the plane of the frame and including means to facilitate securement of said second arm to a support structure, said second arm being movable out of said first condition on release from the support structure.

Further according to the present invention there is provided an artwork frame including at least one support bracket as described in the immediately preceding paragraph in which the first arm is secured to the frame.

By the present invention, the first arm may be permanently secured to the frame such as by a screw-threaded fastener(s) passed through one or more holes through the first arm, with the engaging means thereon used to support the frame from a wall or rail, and when it is desired to relocate the framed artwork the second arm is disposed in its first condition and the frame is secured to a travelling frame or box by the second arm securing means.

The engaging means on the first arm for a wall support element such as a picture wire may comprise a fixed hook, aperture or fixed eyelet but preferably comprises an eyelet rotatable relative to the first arm so that it may lie at the desired angle when used to support the frame artwork and may lie substantially parallel to the plane of the frame when the support bracket is in the travelling mode.

The first arm may take any appropriate shape but it is preferred that at least a substantial part of it have a flat cross-section so as to protrude only marginally from the back of the frame when secured thereto. Conveniently the first arm is elongate and is secured to the frame vertically in which case the engaging means may be disposed at an upper end of the first arm and the second arm projects in its first condition from the lower end of the first arm. Advantageously the first arm has at least two longitudinally spaced holes therethrough, between the engaging means and the connection with the second arm, to receive fasteners for securing the first arm to the frame. Preferably when the first arm securing means comprises one or more holes through the first arm, the or each such hole is countersunk to receive the head of a fastener flush with the first arm.

The second arm may take any appropriate form. Thus it may have sufficient depth for the second arm securing means to comprise a threaded bore formed in the remote end of the second arm along its length so that the second arm is secured to the travelling frame by means of a screw threaded fastener which extends parallel to the length of the second arm. More preferably however, at least a substantial part of the second arm has a flat cross-section so as to protrude only marginally from the back of the frame in which case the second arm securing means may comprise an aperture passing through the second arm perpendicularly to the plane of the frame to receive an appropriate fastener therethrough, or a stud projecting from the second arm to pass through an appropriate opening in the travelling frame or box.

Advantageously, when the second arm is in its first condition it projects beyond the periphery of the frame with the second arm securing means disposed outwardly of the frame periphery. Preferably the second arm is of elongate configuration.

The second arm may be separable from the first arm so that it is only disposed in its first condition when the artwork frame is to be mounted in the travelling frame or box and transported. The connection with the first arm may be by any appropriate means, for example, a sleeved arrangement with the first and second arms being secured by means such as a locking pin or snap engagement. Alternatively, the separable second arm may be secured to the first arm by means of a screw threaded the frame. Since such bottom brackets may not be used for mounting the frame for display the first arms thereof need not be provided with the wall support element engaging means.

The support bracket may be formed in any appropriate material, including steel, brass and plastics, which has sufficient strength to support the artwork on display and to locate it during travel. The second arm securing means may in some conditions be used to secure the frame to a display wall. Thus, for security reasons, the second arm may be bolted to the wall.

Three embodiments of a support bracket in accordance with the present invention will now be described by way of example only with reference to the accompanying drawings, in which.

Figure 3:
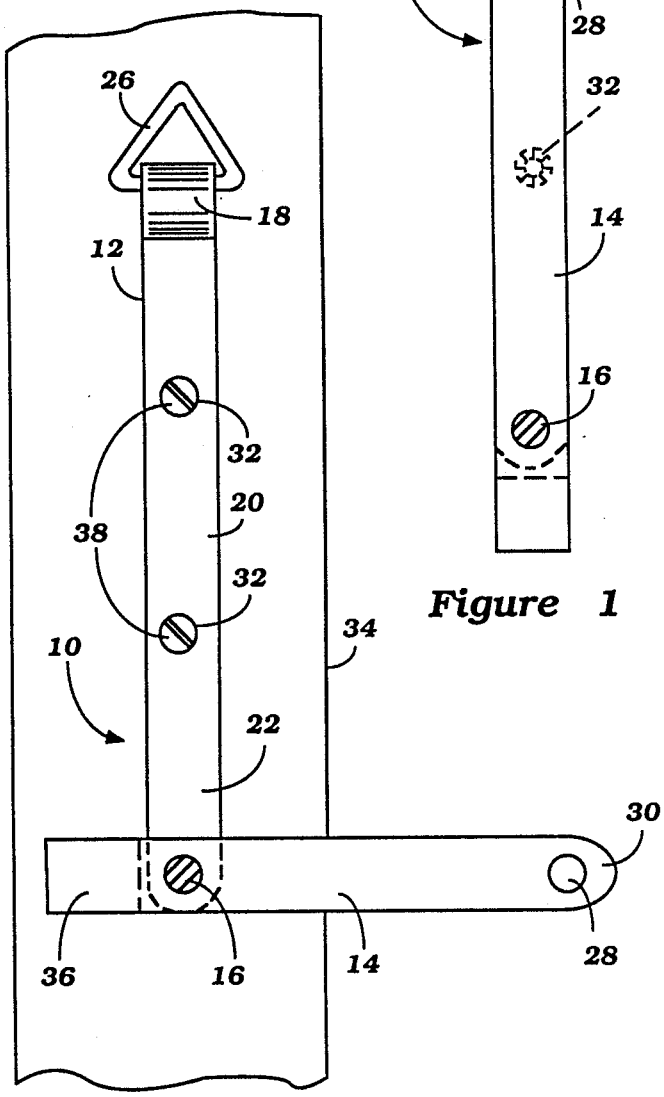
Figure 1:
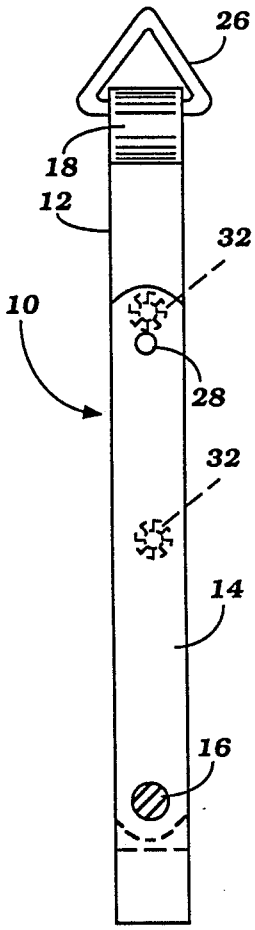
FIG. 1 is a front view of a first embodiment of the bracket in a display condition.
Figure 4:
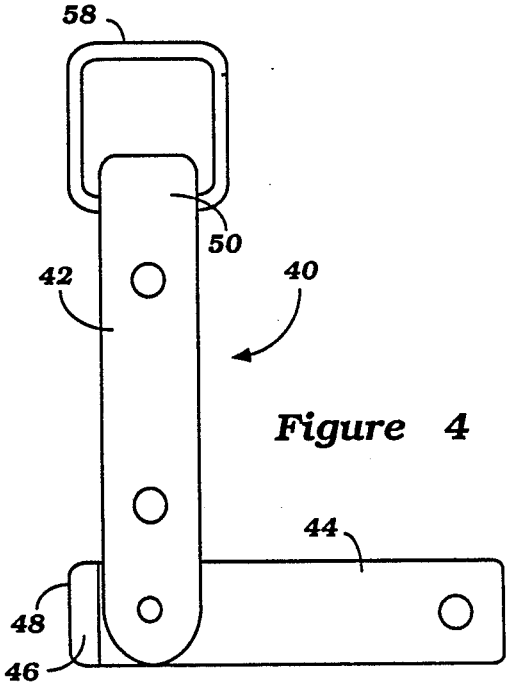
Figure 5:
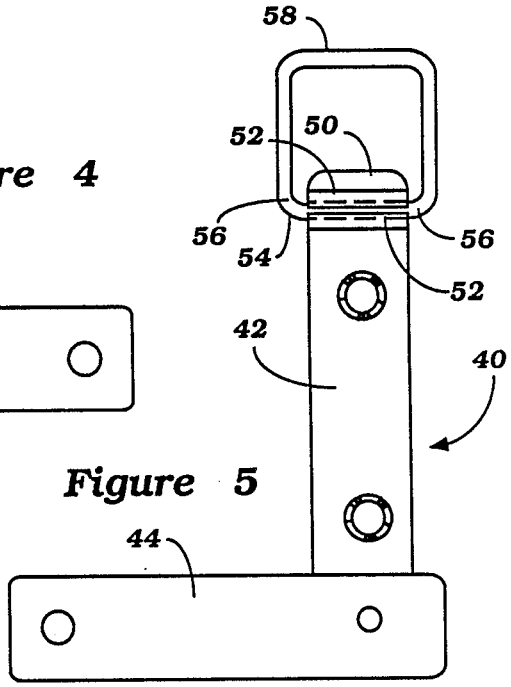

FIG. 3 a view similar to FIG. 1 but showing the bracket secured to part of an artwork frame and in a holding condition;

FIG. 4 is a view similar to FIG. 3 but showing a second embodiment of the bracket not attached to a frame;

FIG. 5 is a rear view of the bracket of FIG. 4; and

Figure 6:
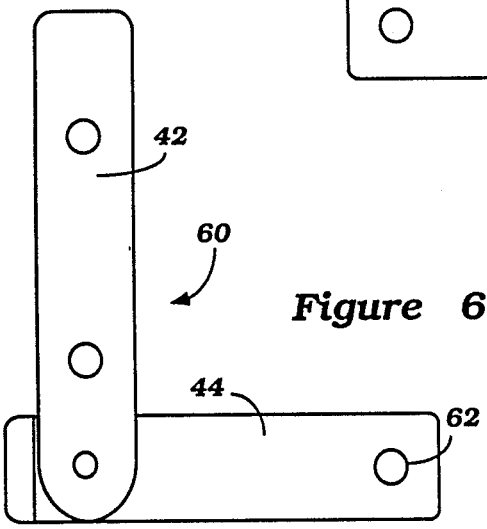

FIG. 6 is a view similar to FIG. 4 but of a third embodiment of the bracket.

Figure 2:
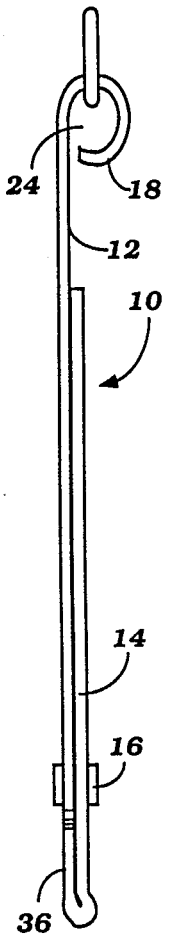
FIG. 2 is a side view of the bracket of FIG. 1 in the display condition.

Referring to FIGS. 1 to 3, there is shown a support bracket 10 comprising a first arm 12 and a second arm 14 pivotally connected thereto at 16.

The first arm is of a substantially elongate or other fastener.

More preferably, however, the second arm is pivotally secured to the first arm for movement substantially parallel to the plane of the frame. The second arm may then be pivoted out of its first condition to a condition in which it is hidden behind the frame when the framed artwork is mounted for viewing. Most preferably the second arm is pivotable to a second condition in which it overlies the first arm and conveniently the first and second arms have substantially the same cross-sections, or at least widths, to present a neat appearance when in said second condition. Means may be provided to temporarily retain the second arm in said second, overlying, condition.

Means may be provided to limit pivotal movement of the second arm relative to the first arm and preferably to define the maximum projection of the second arm into the first condition. Thus preferably the second arm extends perpendicularly to the first arm, parallel to the plane of the frame, in its first condition. The limit means may take any appropriate form but in one embodiment comprises at least one projection on one of the first and second arms which engages the other of the first and second arms at the desired limit(s) of rotation.

Preferably two support brackets in accordance with the invention will be secured to an artwork frame in the normal position of mounting means for engaging a wall support element, for example about one quarter of the height down from the top of the frame and adjacent respective sides of the frame. In addition two more such support brackets may be provided adjacent respective bottom corners of P configuration and comprises integral head, middle and tail portions 18, 20 and 22 respectively.

The head portion 18 has a returned substantially circular end, providing an opening 24 which receives and retains a triangular anchoring ring 26 which is substantially freely rotatable about the enlarged axis defined by opening 24. To the anchoring ring 26, one end of a picture wire, cord or chain (not shown) is tethered while the other end of the picture wire may be similarly secured to the ring of another support bracket 10 located on the opposite side of a frame or to a wall support.

The second arm is connected to the tail portion 22 of the first arm by a rivet 16 which defines the pivot axis. A hole 28 through the remote end 30 of the second arm is adapted to co-operate with a retaining means, for example a bolt protruding through the floor of a travelling box (not shown) or from a travelling frame to secure the framed article to the box.

Securing apertures 32 through the middle portion 20 of the first arm are each adapted to receive a screw or bolt to secure the support bracket to the frame 34 of a framed article. The apertures 32 are counter-sunk so that the screw or bolt-heads may be received flush with the surface of the first arm. The length of the second arm from the pivot point 16 to the end 30 thereof is less than the overall length of the first arm to enable the second arm to pivot about the pivot point 16 beneath the head portion 18.

The second arm is also provided at its end remote from the hole 28 with a returned flange 36 which acts as a stop by abutting the tail portion of the first arm when approximately perpendicular thereto, thereby limiting the degree of movement of the second arm to approximately 180° relative to the first arm. The tail portion 22 of the first arm is rounded as shown by dotted lines in FIG. 1 to facilitate the pivotal movement of the second arm. The returned flange 36 may have a hole or aperture (not shown) therethrough, which would assist in aligning the second arm or maintaining the second arm aligned relative to the first arm or for providing a guide to aid in locating the hole 28 to co-act with the travelling box retaining means.

The first and second arms are of relatively flat cross-section (the curve of the head portion 18 is exaggerated) so as to protrude minimally from the back of the frame 34. The first and second arms may be stamped from steel with the appropriate openings therethrough and with the head portion 18 of the first arm and the returned flange 36 of the second arm flat. The holes 32 may then be countersunk, the first and second arms folded respectively to form the head portion and the returned flange and the eyelet fitted before or after forming the head portion. Finally, the first and second arms may be pivotally connected by means of the rivet 16 for relative movement in their respective principal planes parallel to the plane of the frame 34.

When using the support bracket 10 to suspend a framed article, two support brackets are preferably secured at respective sides of the frame by means of screws 38 so that the eyelets 26 are at normal eyelet or staple height and the first arm extends vertically. The arms are then aligned such that the second arm overlies the first arm so that the second arm is hidden behind the framed article. Although only two such support brackets may be necessary to hang the framed article it is preferred for when the article is moved from one location to another, to locate a similar support bracket adjacent each bottom corner of the frame. In this way, when the framed article is to be transported, the second arm of each support bracket is rotated into a position where it extends beyond the perimeter of the frame, preferably at right angles to the first arm, to co-operate with a suitably located retaining means in the travelling box or frame. Once positioned over the retaining means, complementary fastening means are used to hold the second arm of each support bracket in contact with the retaining means by means of holes 28 to restrain movement of the framed article relative to the box.

Accordingly, as can now be readily appreciated, it is no longer necessary with the support bracket of the present invention to dismantle the mounting means of the framed artwork when the artwork is to be moved and, as a consequence thereof, it is unnecessary to reassemble the mounting means before the framed artwork can be displayed. Thus, upon securing the support bracket of the present invention to the framed artwork, the frame need not be subsequently damaged or weakened by the previous requirement to reinsert the anchoring staples/eyelets, or be inflicted with unnecessary holes therein as was caused by screw-fixing the framed artwork to a support stretcher or travelling frame.

Further, with the support bracket of the present invention, the earlier need for frictional engagement between the travelling frame or support stretcher bearing the framed artwork to restrain its movement in the travelling box is removed. Accordingly, it is no longer necessary to precisely tailor-make a travelling box for a particular framed artwork and oversized boxes can now be used to adequately transport the framed artwork.

As a result of the above, there is observed a noted saving in time, labour and materials for dismantling, moving and reassembling a framed artwork for exhibition. In addition, it is observed that the earlier and unnecessary damage inflicted to the frame of the framed artwork is removed.

Referring now to FIGS. 4 and 5 there is shown a second embodiment 40 of the support bracket which is similar to the support bracket 10 and for that reason will not be described fully. The major difference with the support bracket 40 is that the first and second arms 42 and 44 are cast or moulded in brass or other appropriate metal or plastics so that the returned flange 46 is formed as an integral thickening of the end 48 of the second arm and the head portion 50 of the first arm 42 is formed with a pair of opposed jaws 52 which project from the principal plane of the arm to define a groove 54 therebeneath to receive the opposed ends 56 of the pivotable eyelet 58 therein. The eyelet 58 is shown in this embodiment as of rectangular configuration. The eyelet may be located in the groove 54 by snap engagement between the jaws 52 or by opening up the opposed ends 56 prior to locating them in the groove 54 and then urging them together in the groove. The support bracket 40 has a similar flat cross-section to the bracket 10 and the second arm 44 may also be pivoted to overlie the first arm 42 when not in use. Further, the bracket 40 is used in the same way as bracket 10.

Referring now to FIG. 6, there is shown a modification 60 of the support bracket 40. The locating bracket 60 is identical to the bracket 40 except that the head portion 50 and the eyelet 58 are omitted. The bracket 60 would accordingly not normaly be used for suspending a frame but may be disposed, for example, at a bottom corner of a frame in the manner of brackets 10 and 40 and be used by means of second arm 44 thereof to locate the frame in a travel box as described above with reference to bracket 40. In addition the second arm 44 of the bracket 60 may be used to secure the frame to a wall by passing a bolt through the hole 62 and through the wall and securing the bolt therein.

I claim:

1. A support bracket for the frame of artwork for supporting said artwork for shipment without removal of said bracket and comprising a first arm having means for securing said first arm to the frame, and a second arm movably supported by said first arm between a first condition projecting from the first arm substantially parallel to the plane of the frame and extending outwardly therefrom and said second arm having attachment means for attachment of said bracket and said frame to a support structure for shipment, said second arm being moveable from said first condition to a concealed position behind said frame for display of said artwork.

2. A support bracket as claimed in claim 1 wherein the first arm securing means comprises at least one hole passing through the first arm to receive a fastener therethrough.

3. A support bracket as claimed in claim 1 wherein the first arm carries means for hanging the artwork for display comprises an eyelet rotatable relative to the first arm.

4. A support bracket as claimed in claim 1 wherein the second arm securing means comprises at least one hole passing through the second arm to receive a fastener therethrough.

5. A support bracket as claimed in claim 1 wherein the second arm is pivotally secured to the first arm for movement substantially parallel to the plane of the frame.

6. A support bracket as claimed in claim 5 wherein the second arm is pivotally movable from said first condition to a second condition in which it overlies the first arm.

7. A support bracket as claimed in claim 5 including means to limit said pivotal movement of the second arm.

8. A support bracket as claimed in claim 1 wherein each of the first arm and second arm is elongate and substantially of a flat cross section.

9. A support bracket as claimed in claim 8 wherein the flat cross-sections of the first and second arms are substantially the same.

* * * * *